US005947766A

United States Patent [19]

Tsuji et al.

[11] Patent Number: 5,947,766

[45] Date of Patent: Sep. 7, 1999

[54] FITTING STRUCTURE FOR CONNECTOR HOUSING

[75] Inventors: Takeshi Tsuji, Yokkaichi; Takao Otsuki, Hino; Tomohiro Nagase, Hino; Hisashi Muraji, Hino, all of Japan

[73] Assignees: Sumitomo Wiring Systems, Ltd.; Hino Motors, Inc., both of Japan

[21] Appl. No.: 08/975,336

[22] Filed: Nov. 20, 1997

[30] Foreign Application Priority Data

Nov. 22, 1996 [JP] Japan ..... 8-312281

[51] Int. Cl.[6] ..... H01R 13/73

[52] U.S. Cl. ..... 439/559; 439/564

[58] Field of Search ..... 439/559, 564, 439/384, 556, 548

[56] References Cited

U.S. PATENT DOCUMENTS 4,684,190 8/1987 Clark ..... 439/559

*Primary Examiner*—Steven L. Stephan
*Assistant Examiner*—Javaid Nasri
*Attorney, Agent, or Firm*—Jordan B. Bierman; Bierman, Muserlian and Lucas

[57] ABSTRACT

A fitting structure for a connector housing can maintain a stable vibration absorbing function. A flange (14) of a connector housing (10) is provided on the periphery with an outer annular retaining wall (15). A rubber sheet (20) is contained in an interior of the connector housing (10). The connector housing (10) is attached to a body (E) of an engine by means of bolts (B) and nuts (N). When fattening bolts (B) and nuts (N), the rubber sheet (20) is compressed. In a conventional fitting structure, the compressed rubber sheet (20) expands laterally to bulge out of the flange (14). Since the outer annular retaining wall (15), however, serves to limit the lateral expansion of the rubber sheet (20) so that the rubber sheet (20) does not bulge out from the flange (14), it is possible to prevent the rubber sheet (20) from changing its physical and/or chemical nature and to effectively maintain its vibration absorbing function.

14 Claims, 7 Drawing Sheets

FITTING STRUCTURE FOR CONNECTOR HOUSING

BACKGROUND OF THE INVENTION

This invention relates to a fitting structure which is adapted to attach a connector housing to another element.

For convenience of explanation, a typical example of a conventional fitting structure for a connector housing will be described below by referring to FIG. 10. FIG. 10 is a perspective view of a conventional connector housing. A connector 1, as shown in FIG. 10, comprises a male connector housing 2 and a female connector housing 3. The male connector housing 2 is provided on a rear end of a connecting part thereof with an oval flange 4, in which a pair of bores 4*a*, 4*a* are formed.

As shown in FIG. 10, the oval flange 4 is directly attached to a wall of another element 5 and is secured to the wall by screwing a bolt B through the bore 4*a* into the element 5.

Since the flange 4 of the conventional connector 1 is directly attached and secured to another element 5, in the case where the element 5 vibrates, the connector 1 is subject to adverse influence due to vibration.

In order to suppress the vibration, a rubber sheet (not shown) may be disposed between the flange 4 and the element 5. However, the rubber sheet has the following problem. The rubber sheet should have a large area to be attached to the connector so as to much absorb the vibration. That is, it is preferable to cover a whole surface of the flange with the rubber sheet. However, if a rubber sheet which is aligned with the outer edge of the flange is used, the rubber sheet becomes compressed as the bolts are fastened and thus the rubber sheet will expand laterally and bulge outwards from the flange. Then, the bulging portion of the rubber sheet will be directly subject to an influence under an external condition. Thus, for example, contact with a working tool will cause damage to the rubber sheet and any sticking of oil will change a nature of the rubber sheet. Consequently, a vibration absorbing function of the rubber sheet will be lowered.

SUMMARY OF THE INVENTION

An object of the present invention is to provide a fitting structure for a connector housing which can protect a side edge of a vibration absorbing member and maintain a stable vibration absorbing function of the member.

In order to achieve the above object, a fitting structure for a connector housing in accordance with the present invention comprises: a flange provided on the connector housing for attaching the connector housing to a mating element; a vibration absorbing member disposed between the housing flange and the mating element; means for fastening the housing flange to the mating element; and a retaining wall provided on at least one of the housing flange and the mating element for preventing the vibration absorbing member from bulging out from an outer periphery of the housing flange when fastening the housing to the mating element.

According to the above structure, even if the vibration absorbing member is compressed by the fastening force to the housing flange, the retaining wall can prevent the vibration absorbing member from bulging out from the housing flange. This will prevent damage and deterioration of the vibration absorbing member due to physical and chemical causes and will enhance a function of the member.

In the fitting structure for a connector housing, the housing flange and the vibration absorbing member may be provided with bores which are registered with each other on both sides. A spacer may be fitted in each bore to permit a bolt to pass therethrough. The spacer abuts on the mating element when screwing the bolt thereby defining a gap between an end surface of the retaining wall on one part and an opposite surface on the other part.

According to the above structure, when the bolt is screwed into a nut until the end surface of the spacer abuts on the mating element while compressing the vibration absorbing member between the housing flange and the mating element, the retaining wall provided on either the housing flange or the mating element is held at a certain gap to the opposed element. Consequently, the retaining wall which serves to protect the vibration absorbing member does not transmit any vibration between the housing flange and the mating element.

In the fitting structure for a connector housing, the vibration absorbing member may be provided around the bore with a sleeve portion having a flange which is exposed on the outer side of the bore in the housing flange. The sleeve flange is disposed between the housing flange and the bolt to be clamped.

According to the above structure, since the sleeve with the flange is disposed between the housing flange and the bolt, transmission of vibration therebetween can be avoided and the vibration absorbing member can perform its own function.

In the fitting structure for a connector housing, the spacer may be provided on a bolt side end with a spacer flange which is opposed through the sleeve flange to the housing flange. A retaining wall which prevents the sleeve flange from bulging out from the outer periphery of the spacer flange when fastening said sleeve flange may be formed on at least one of the spacer flange and the housing flange.

According to the above structure, it is possible to prevent the sleeve flange from bulging out from the spacer flange by means of the retaining wall even if the sleeve flange is compressed by the fastening force to the housing flange. Consequently, damage and deterioration of the sleeve flange due to physical and chemical causes can be prevented and thus the function of the vibration absorbing member can be maintained.

In the fitting structure for a connector housing, a sealing member may be disposed between the mating element and the connector housing. The spacer flange is opposed to the housing flange through a given gap. The spacer is brought into contact with the housing flange when the connector housing is displaced, thereby defining a stopper means for limiting an extent of displacement of the connector housing.

According to the above structure, since it is possible to limit the extent of displacement of the connector housing by the stopper means, the sealing member can be maintained in a compressed state, thereby preventing, for example, oil leakage.

In a fitting structure for a connector housing, the vibration absorbing member may be formed together with the housing flange.

According to the above structure, it is possible to decrease the number of parts and to make an assembling process easy.

In a fitting structure for a connector housing, the vibration absorbing member may be made of a soft resin material and the housing flange may be made of a hard resin material.

According to the above structure, it is possible to produce the respective parts to have, for example, two colors.

DETAILED DESCRIPTION OF THE PREFERRED EMBODIMENTS

Figure 9:
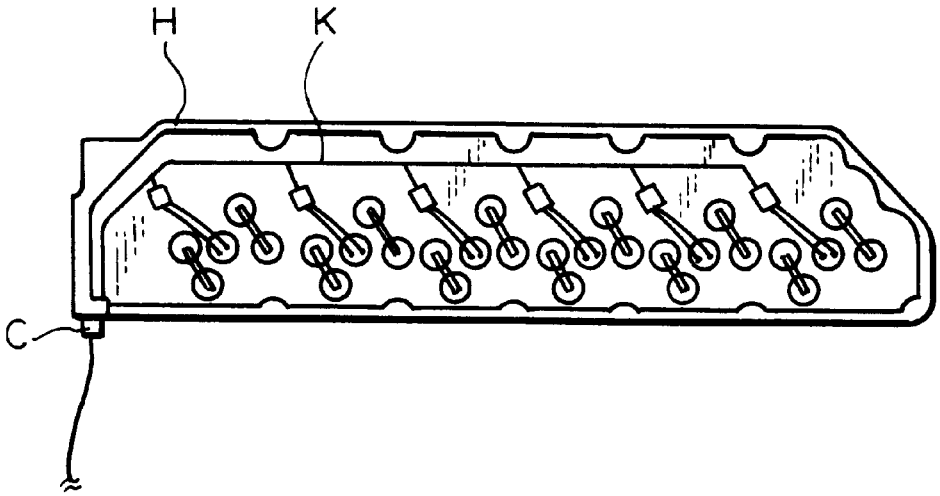
FIG. 9 is a plan view of a cylinder head a cover of which is removed.
Figure 10:
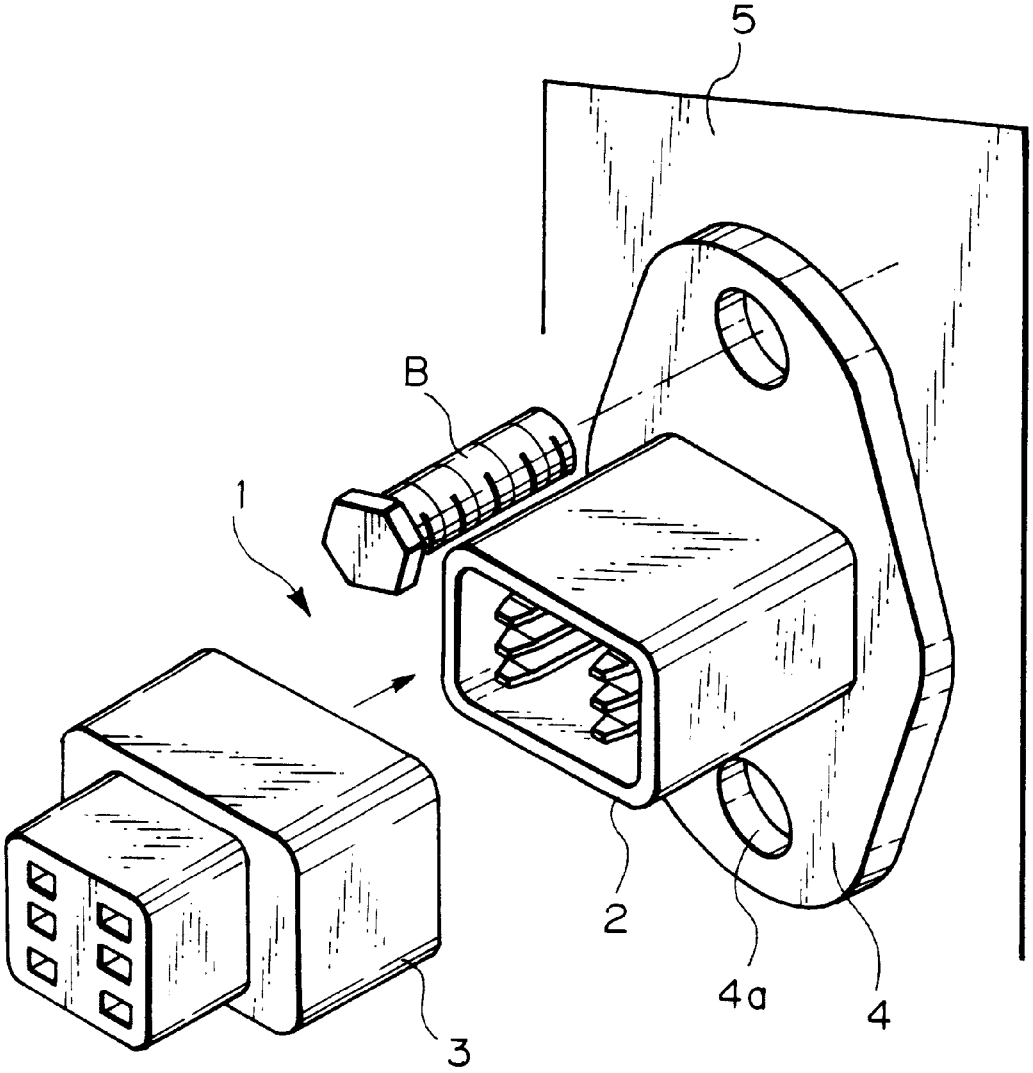
Fig. 10 PRIOR ART
FIG. 10 is a perspective view of a conventional connector housing.

Referring now to the drawings, a first embodiment through a third embodiment of a fitting structure for a connector housing in accordance with the present invention will be described below. In these embodiments, a connector C to which the present invention is applied is attached to a side wall of a cylinder head H of an engine for a vehicle. The connector C is used to connect a harness K (FIG. 9) of an injection line in the cylinder head H to an external circuit.

A First Embodiment

Figure 1:
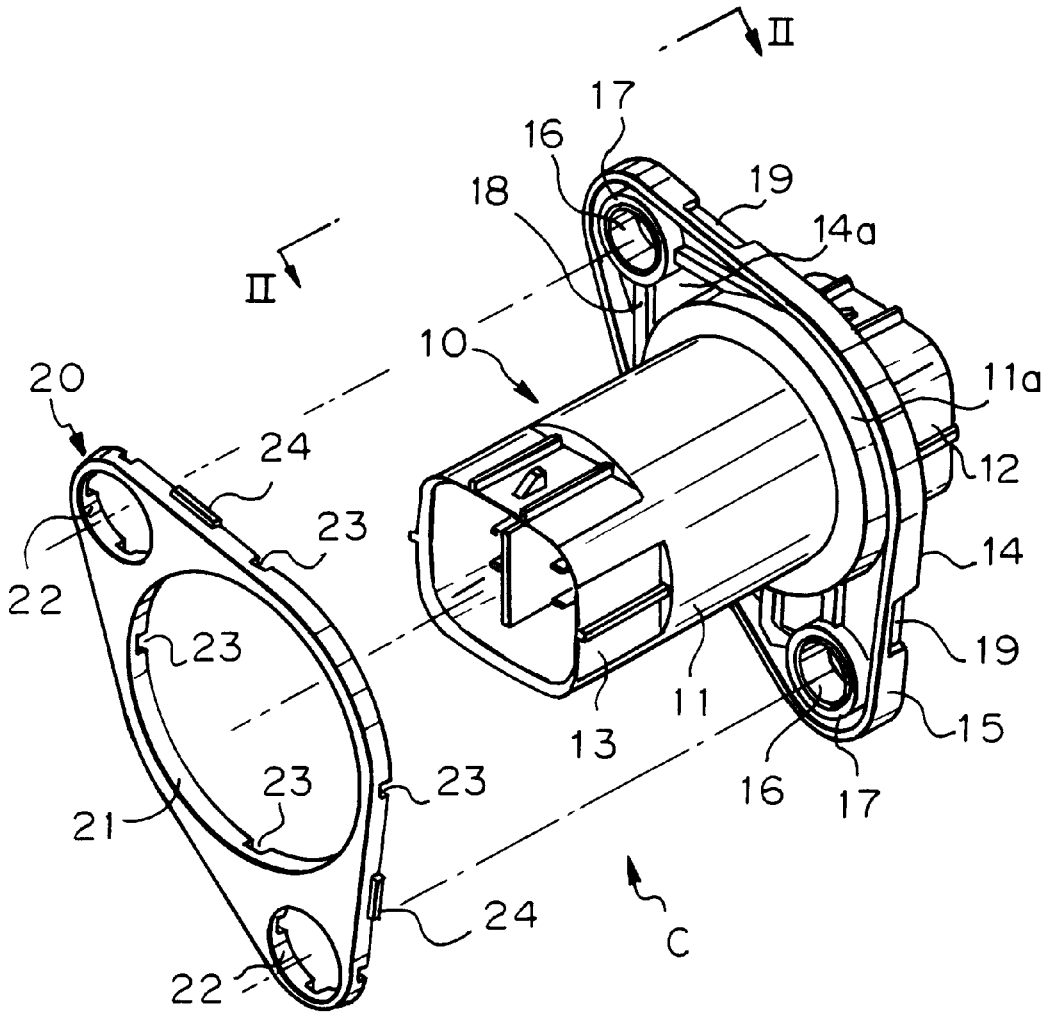
FIG. 1 is a perspective view of a connector housing and a rubber sheet in a first embodiment of a fitting structure for a connector housing in accordance with the present invention.
Figure 2:
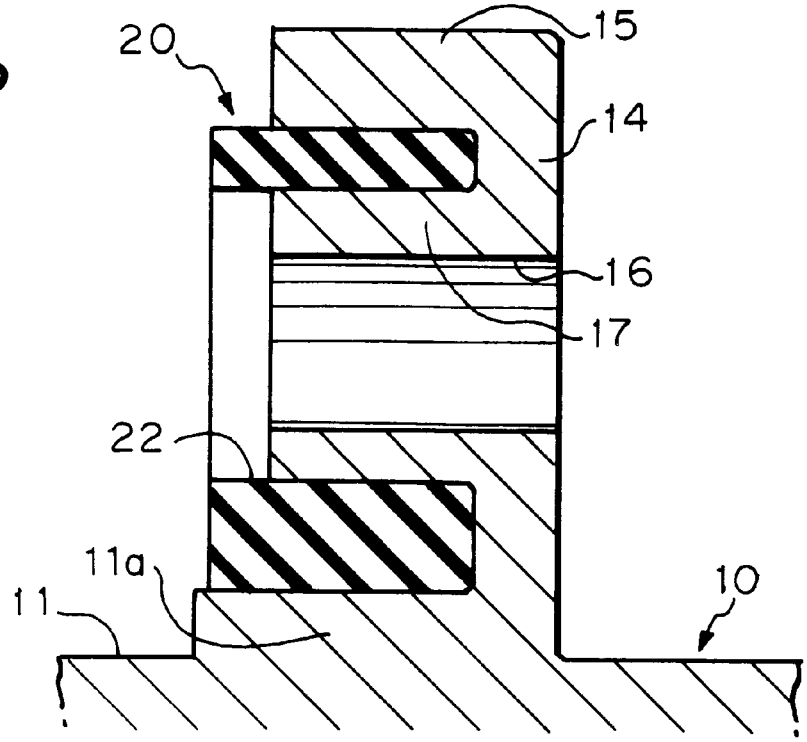
FIG. 2 is a fragmentary longitudinal sectional view taken along a line II—II in FIG. 1.
Figure 3:
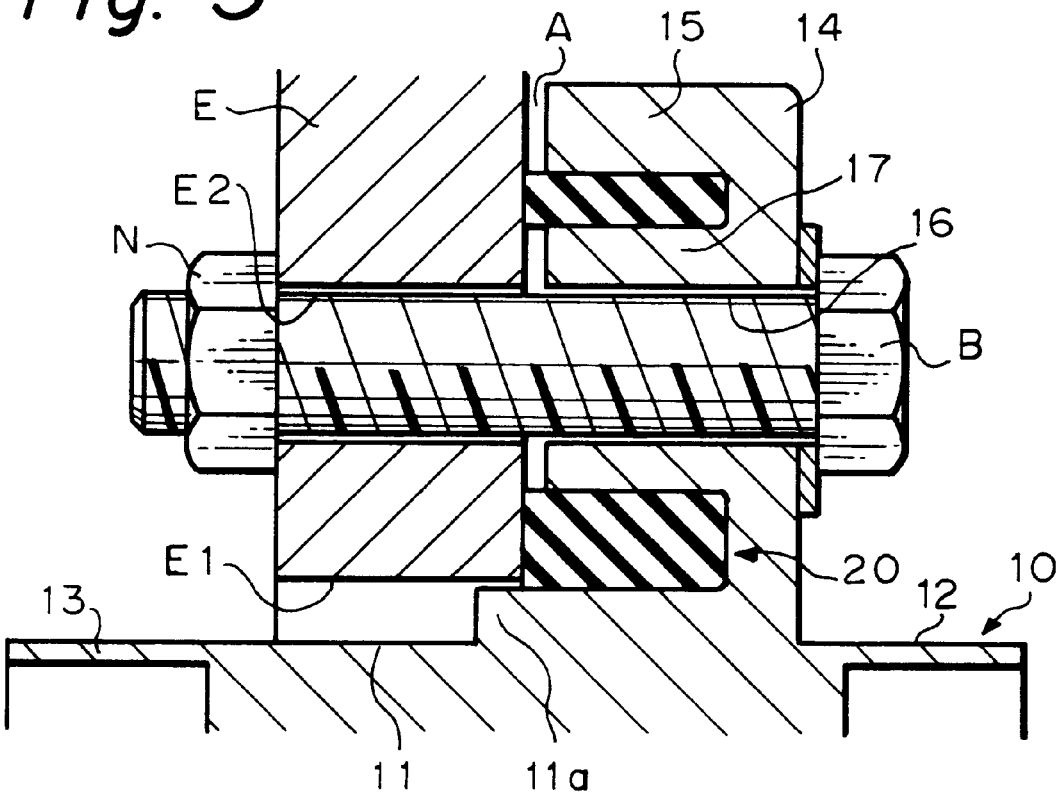
FIG. 3 is a fragmentary longitudinal sectional view of the connector housing attached to a mating element.

FIGS. 1 to 3 show a first embodiment of a fitting structure for a connector housing in accordance with the present invention.

A connector housing 10, as shown in FIG. 1, is provided on the opposite ends of a cylindrical body 11 with hood like connecting parts 12 and 13 each having a rectangular cross section. A male tab provided in the connector housing 10 is adapted to be coupled to a terminal provided in a mating connector housing (not shown).

The body 11 is provided on a rear end of a whole outer periphery with a ring like collar 11*a*. An oval shape housing flange 14 is formed around the collar 11*a* on the outer periphery of the housing 10. The flange 14 is provided on the periphery with a retaining wall such as outer annular wall 15 which extends inwardly to face to the engine at a uniform height. A vibration absorbing member in the form of rubber sheet 20 to be described hereinafter is fitted in a containing space 14*a* defined between the outer annular wall 15 and the collar 11*a*. The flange 14 is provided in opposite convergent ends with bolt-through bores 16, 16 which include housing sleeves 17, 17 extending in the same direction as the outer annular wall 15. Ribs 18 bridge a gap between the housing sleeves 17 and the collar lha to reinforce the flange 14.

The rubber sheet 20 may be made of, for example, a silicone rubber durable to a heat of 200° C. and formed into a configuration adapted to be generally fitted in the containing space 14*a*. Preferably, the rubber sheet 20 is provided in the central part with a large insertion hole 21 adapted to permit the collar 11*a* to closely pass therethrough and in opposite ends with small insertion holes 22, 22 adapted to permit the short sleeves 17 to closely pass therethrough. The rubber sheet 20 is also provided around the large insertion hole 21 with escape recesses 23 which are opposed to the flange 14 to prevent the ribs 18 from interfering with the rubber sheet 20.

A thickness of the rubber sheet 20 to be received in the containing space 14*a* is greater than a height of the outer annular wall 15. The rubber sheet 20, as shown in FIG. 2, projects from a side end surface of the outer annular wall 15 toward the engine in a normal condition before the connector housing 10 is attached to the engine. After the connector housing 10 is attached to the engine, the rubber sheet 20 is compressed to defined a clearance A between the engine and the side end surface of the outer annular wall 15, as shown in FIG. 3. It is preferable to make a clearance between the inner peripheral surface of the outer annular wall 15 and the outer peripheral surface of the rubber sheet so as to contain the rubber sheet 20 in the containing space 14*a* before attaching the connector housing 10 to the engine. When the rubber sheet 20 is compressed by attaching the housing 10 to the engine, the rubber sheet 20 expands radially to come into a close contact with the interior of the containing space 14*a* in the housing flange 14.

The rubber sheet 20 is provided on the outer periphery of the opposite ends with two ridges 24, 24 which are adapted to engage with recesses 19, 19 in the flange 14 to secure the rubber sheet 20 to the connector housing 10.

Referring now to FIG. 3, the connecting part 13 of the connector housing 10 adapted to be attached to the engine is described below. A portion of a mating element or body E of the engine adapted to face to the flange 14 is formed into a flat configuration. The flat portion provided with a body-through bore E1 adapted to permit the body 11 of the connector housing 10 to pass therethrough and a pair of bolt-through bores E2, E2 each adapted to permit a bolt B to pass therethrough. The bolt B passes through a bolt bore 16 in the flange and enters the bolt-through bore E2. When the body 11 of the connector housing 10 is inserted into the body-through bore E1 in the engine body E so that the rubber sheet 20 in the containing space 14*a* in the flange 14 abuts on the engine body E, the connecting parts 12 and 13 of the connector housing 10 are disposed outside and inside the engine body E, respectively. Then, the connector housing 10 is ready for receiving a mating connector (not shown) in order to complete an electrical connection of an injection.

Next, a process for attaching the connector housing 10 to the engine body E will be explained below.

First, the body 11 is inserted into the body-through bore E1 while holding the rubber sheet 20 in the containing space 14*a* in the connector housing 10. Secondly, the bolt B is inserted through the bolt bore 16 in the flange 14 into the bolt-through bore E2 in the engine body E and a nut N is screwed on the bolt B. Thirdly, the nut N is fastened on the bolt B until the rubber sheet 20 is compressed to a certain extent. Then, the attachment of the connector housing 10 is completed. Preferably, for example, a plate like spacer is disposed between the opposite ends of the outer annular wall 15 and the engine body to maintain a constant amount of compression of the rubber sheet 20, thereby separating the opposite ends of the outer annular wall from the engine body E.

In the connector housing 10 attached to the engine, the connecting portions of the male and female connector housings are not subject to ill affection due to vibration from the engine since the rubber sheet can absorb and relax the vibration effectively.

Also, in this embodiment, since the outer annular wall 15 encloses the periphery of the rubber sheet 20, it does not bulge out of the flange 14 due to compression. Thus, a tool does not strike a bulging portion of the rubber sheet 20 accidentally and any spilt oil hardly enters a clearance between the outer annular wall and the engine body and does not reach the rubber sheet 20. Accordingly, it is possible to prevent the rubber sheet 20 from deteriorating its function of absorbing the vibration.

A Second Embodiment

Next, referring to FIGS. 4 to 6, a second embodiment of a fitting structure for a connector housing will be described below.

Figure 4:
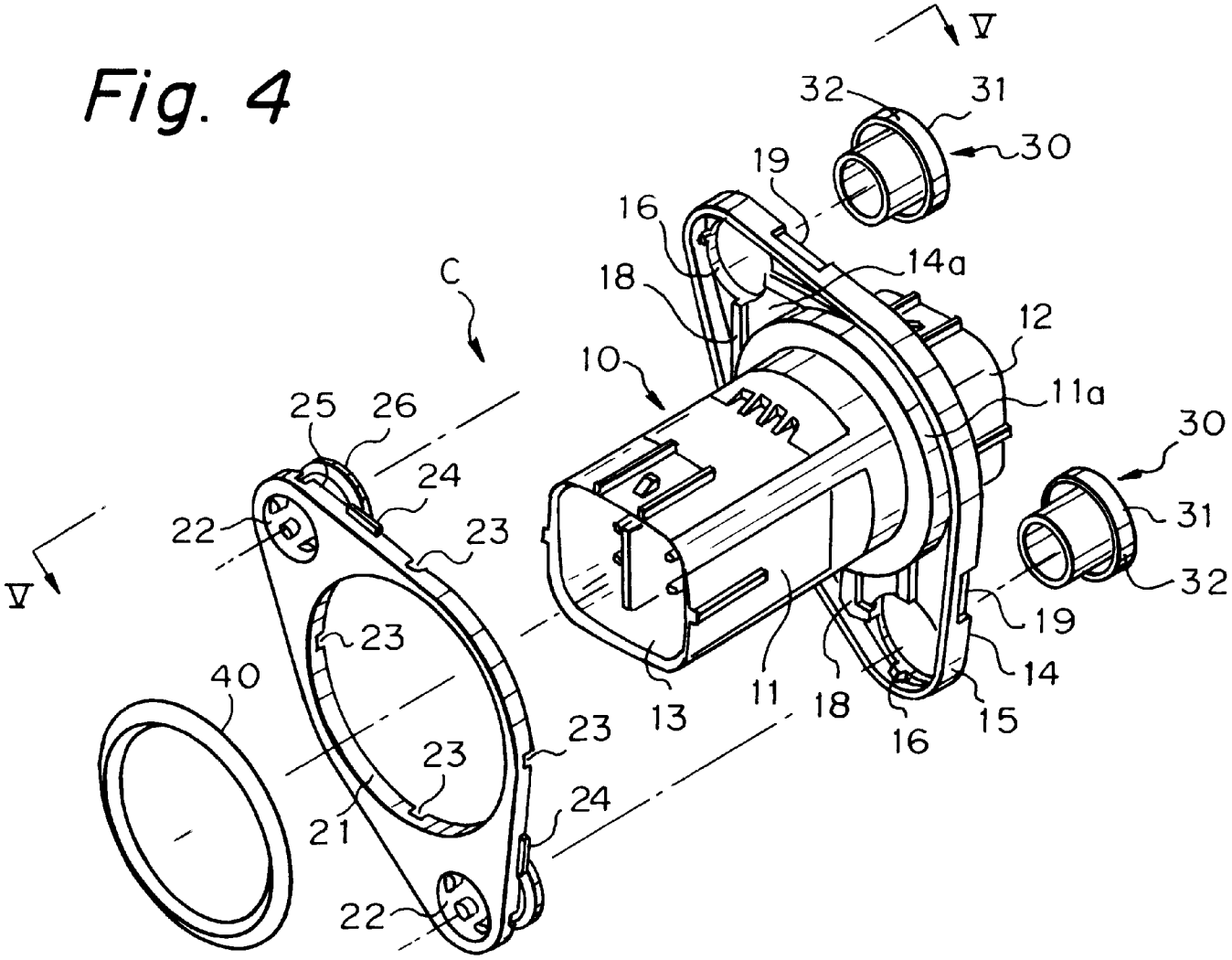
FIG. 4 is a perspective view of a second embodiment of a connector housing and a rubber sheet in a fitting structure in accordance with the present invention.

The second embodiment, as shown in FIG. 4, is different from the first embodiment with respect to a construction of a bolt-fastening part in the flange 14. The connector housing 10 is attached through an O-ring 40 to the engine body E. Since the other construction is substantially the same as that of the first embodiment, the same elements and portions are indicated by the same reference numbers and signs and the construction, operation, and effect are omitted here.

Figure 5:
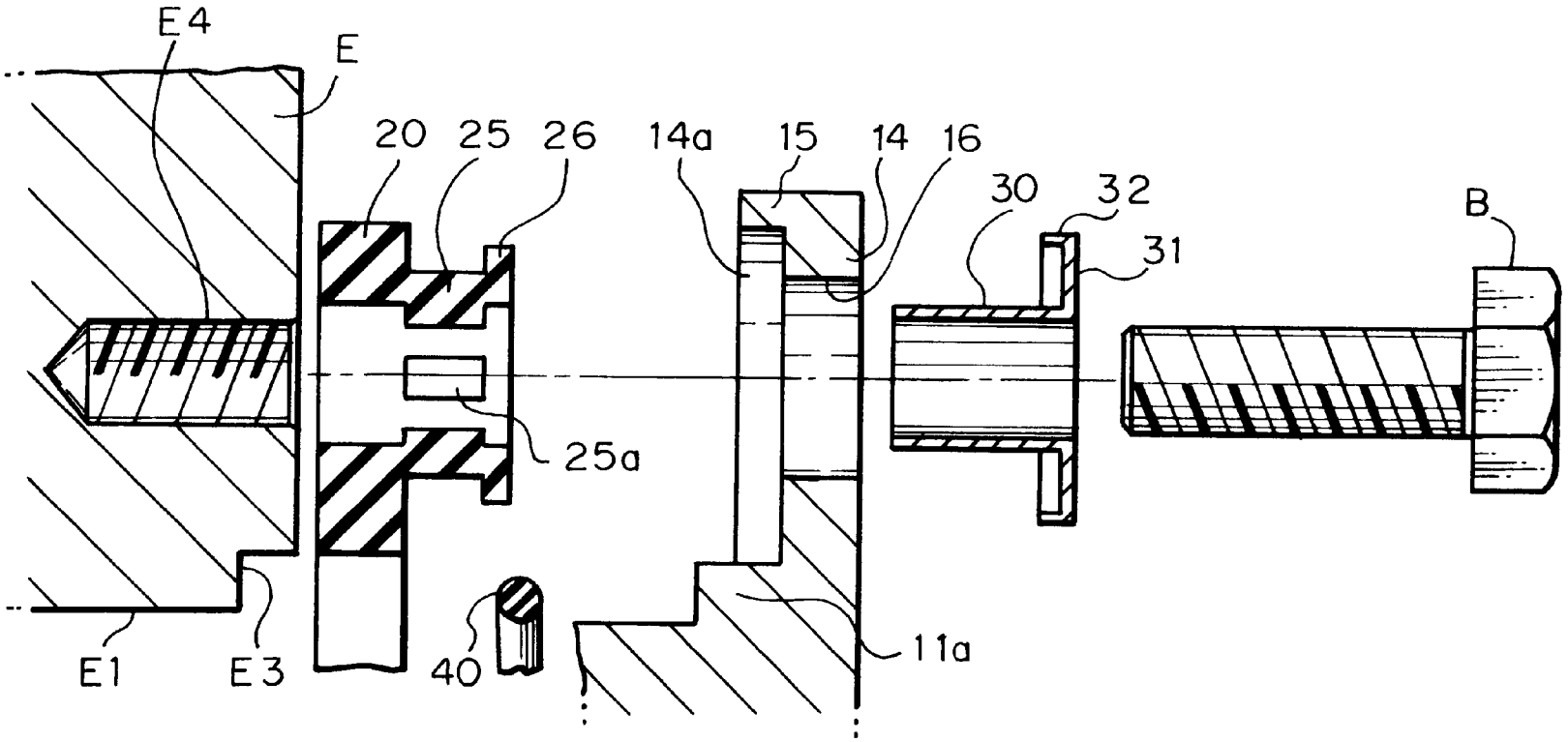
FIG. 5 is a fragmentary longitudinal sectional view taken along a line V—V in FIG. 4.
Figure 6:
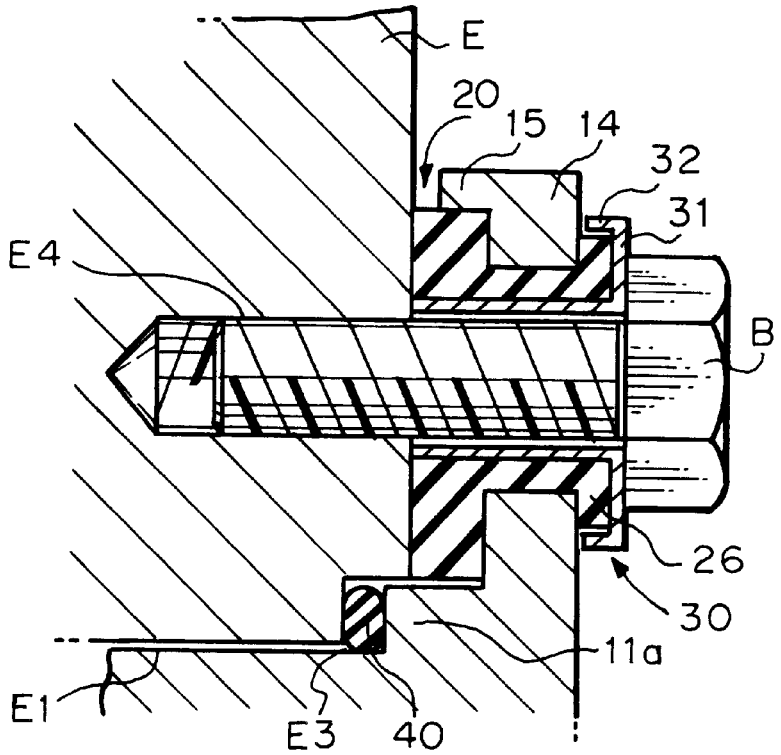
FIG. 6 is a fragmentary longitudinal sectional view of the connector housing shown in FIG. 5, illustrating a position of attaching the connector housing to the mating element.

As shown in FIG. 5, the flange 14 of the connector housing 10 in the present embodiment is provided with the bolt-through bores 16, which are similar to the bores 16 in the first embodiment. The rubber sheet 20 is provided with sleeves each having a flange adapted to be inserted into the bolt-through bore 16. That is, the rubber sheet 20 includes on each end resilient rubber sleeve 25 having resilient rubber flange 26 provided on the rear end of the sleeve 25. The rubber sleeve 25 is adapted to cover the inner periphery of and the rear end surface around the bolt-through bore 16. The rubber sleeve 25 is provided on the inner periphery with a plurality of ridges 25*a* extending axially in parallel to each other. When a bush 30 to be described hereinafter is pushed into the rubber sleeve 25, the ridges 25*a* are elastically compressed by the bush 30, thereby preventing the bush 30 from coming out of the sleeve 25.

The housing sleeve is represented by inserted into the rubber sleeve 25. The bush 30 is formed into a cylindrical shape and is provided on the rear end with a bush flange 31 extending outwardly in a radial direction. The bush 30 covers the inner periphery of the rubber sleeve 25 and the rear end surface of the rubber flange 26 while the bolt B can pass through the bush 30.

The bush flange 31 is provided on the periphery with a retaining wall in the form of a bush side wall 32 extending toward the flange 14 to cover the outer periphery of the rubber flange 26, thereby preventing the rubber flange from bulging out from the bush 30 in the same manner as the outer annular wall 15 of the flange 14 in the first embodiment.

Preferably, a length of the bush 30 is designed to realize the following condition.

First, when the bush 30 is inserted into the rubber sleeve 25, the bush 30 does not protrude its distal end from the front end side (engine side) surface of the rubber sleeve 25. When the bolt B is inserted into the bush 30 and the connector housing 10 is attached to the engine body E in the same manner as the first embodiment, the rubber sheet 20 is compressed by the bolt B so that the distal (front) end of the bush 30 abuts on the engine body E. At that time, the outer annular wall 15 is separated from the engine body E. Also, the rubber flange 26 is disposed between the flange 14 and the bush side wall 32 and thus the bush side wall 32 is separated from the flange 14 (see FIG. 6).

In this embodiment, the O-ring 40 is compressed between the end surface of the collar 11*a* of the connector housing 10 and a shoulder portion E3 of the inner peripheral wall of the body-through bore E1, thereby preventing the oil from leaking out of the engine body E. In addition, the leakage of oil from the bolt attaching portion can be prevented by changing the bolt-through bore E2 in the first embodiment to a screwed bore E4 which is open to only a connector housing side.

In the connector housing 10 thus constructed, an amount of compression of the rubber sheet 20 becomes constant independent upon an extent of fastening the bolt B, since an amount of fastening of the bolt B is determined by abutment of the metallic bush 30 onto the engine body E. Accordingly, the rubber sheet 20 can perform its stable function of absorbing the vibration.

Further, the rubber sleeve 25 can absorb the vibration transmitted through the bolt B from the engine, thereby protecting the connecting portions of the connector housing 10 from the vibration.

A Third Embodiment

Figure 7:
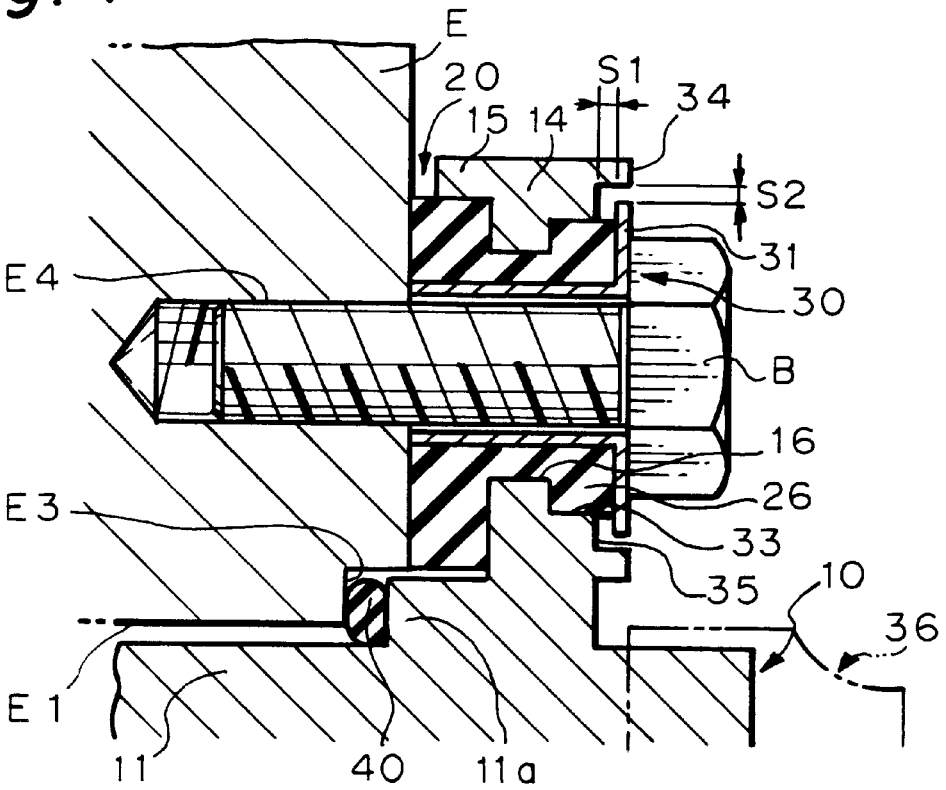
FIG. 7 is a fragmentary longitudinal sectional view of a third embodiment of a fitting structure for a connector housing in accordance with the present invention.
Figure 8:
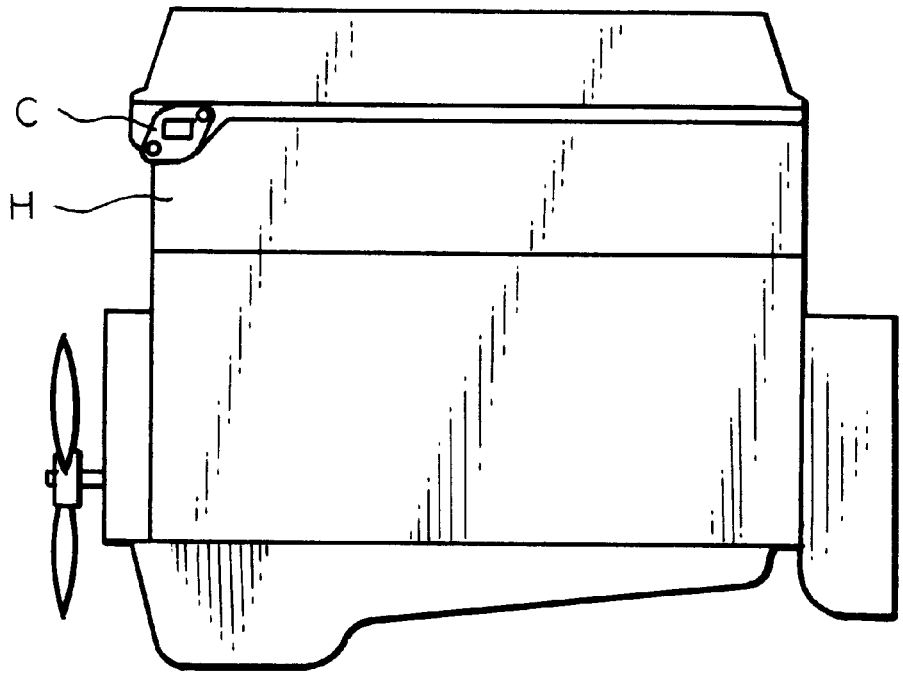
FIG. 8 is a side elevational view of an engine.

Next, a third embodiment of a fitting structure for a connector housing in accordance with the present invention will be described below by referring to FIG. 7. The third embodiment is different from the second embodiment in the following respect. The same elements and portions in the third embodiment as those in the second embodiment are indicated by the same reference numbers and signs in the second embodiment. The description of the same construction, operation, and effect is omitted here.

In the third embodiment, the flange 14 is provided around an opening of the bolt-through bore 16 with a shoulder portion. An inner peripheral wall 33 of the shoulder portion serves as a building prevention wall for the rubber flange 26. Accordingly, the metallic bush 30 is provided with only the bush flange 31 having no bush side wall 32 which serves as the bulging prevention wall in the second embodiment. The bush flange 31 has an outer diameter greater than that of the rubber flange 26 and faces the flange 14 through a clearance S1 between the inner side surface of the bush flange 31 and the outer side surface 35 of the flange 14. When a mating connector housing 36 is detached from the connector housing 10, the housing 36 pulls the housing 10 in a separating direction from the engine body E while compressing the rubber flange 26. The maximum displacement of the housing 10 is limited by the abutment of the surface 35 onto the bush flange 31. This maximum displacement corresponds to the clearance S1. The O-ring 40 is designed so that it can maintain the sealing function even if the housing 10 moves away from the engine body E.

The flange 14 is also provided on the outer side surface 35 with a retaining wall in the form of an annular wall 34 enclosing the bush flange 31 through a clearance S2. The bush flange 31 and annular wall 34 define the maximum displacement of the connector housing 10 relative to the engine body E exerted by the vibration of the engine. The clearance S2 corresponding to the maximum displacement serves to limit a clearance between the body-through bore E1 and the body 11, thereby preventing the O-ring 40 from falling down.

The third embodiment thus constructed can maintain the sealing function of the O-ring 40 and prevent leakage of oil in addition to the effects obtained by the first and second embodiments. Consequently, there is no problem of oil leakage even if a great force is applied to the connector housing 10, for example, upon removal of the mating housing 36 from the housing 10. According to the above construction, it is possible to prevent an excess compression from being applied to the rubber sheet 20, by means of limiting the quantity of displacement of the rubber sheet 20, thereby preventing deterioration of the rubber sheet 20.

The Other Embodiments

It should be noted that the present invention is not limited to the above embodiments. For example, the following embodiments can be included in a technical scope of the invention. The present invention can be carried out by various alteration within the scope of the invention.

(1) Although the connector housing 10 is attached to the engine body E in the first and second embodiments, the housing 10 may be attached to, for example, a body of an automobile vehicle, a machine tool, or the like.

(2) Although the outer annular wall 15 enclosing the side surface of the rubber sheet 20 is formed on the periphery of the flange 14 in the first and second embodiments, the outer annular wall 15 is not necessarily provided on the connector housing 10. For example, the wall 15 may be formed on the engine body E to enclose the side surface of the rubber sheet 20.

However, in the case where the outer annular wall is provided on the connector housing as shown in the first and second embodiments, it is possible to lower a producing cost since the outer annular wall can be formed together with the connector housing.

(3) The flange 14 may be provided with a side wall enclosing the side wall of the rubber flange 26 in place of the bush side wall 32 enclosing the rubber flange 26 in the second embodiment.

(4) Although the rubber sheet 20 for absorbing the vibration is made separately from the flange 14 in the first to third embodiments, the rubber sheet 20 may be formed integrally with the flange 14. For example, the flange may be made of a material vulcanized with rubber, or the flange may have a multilayer structure in which a core layer made of a hard resin material is coated with a cover layer made of a soft resin material (for example, hard urethane resin or the like) for absorbing the vibration.

It is possible to reduce the number of parts and enhance an assembling process in the case of forming the vibration absorbing member together with the flange.

A conventional two color injection molding method can produce the vibration absorbing member made of a soft resin material and the flange made of a hard resin material.

(5) Although the rubber sheet 20 is used as a vibration absorbing member in the first to third embodiments, the vibration absorbing member may be made of, for example, a soft resin material, or the like in lieu of a rubber material. The vibration absorbing member may be made of any material adapted to absorb any vibration.

The entire disclosure of Japanese Patent Application No. HEI 8-312281 Filed on Nov. 22, 1996 including specification, claims, drawings and summary is incorporated herein by reference in its entirety.

What is claimed is:

1. A fitting structure for a connector housing comprising:

a housing flange on said connector housing to attach said connector housing to a mating element;

a vibration absorbing member between said housing flange and said mating element;

a fastener for securing said housing flange to said mating element;

a retaining wall having an end surface on at least one of said housing flange and said mating element to prevent said vibration absorbing member from bulging outward from an outer periphery of said housing flange when fastening said housing flange to said mating element, said housing flange and said vibration absorbing member being provided with bores which are in register with each other on both sides, wherein a housing sleeve is in each of said bores to permit a bolt to pass therethrough, and wherein said housing sleeve abuts said mating element when said bolt is tightened, thereby defining a gap between said end surface of said retaining wall and an opposite surface of either said mating element or said housing flange.

2. A fitting structure for a connector housing according to any one of claims 1, wherein said vibration absorbing member is formed together with said housing flange.

3. A fitting structure for a connector housing according to claim 2, wherein said vibration absorbing member is made of a soft resin material and said housing flange is made of a hard resin material.

4. A fitting structure for a connector housing according to claim 1, wherein said vibration absorbing member is formed together with said housing flange.

5. A fitting structure for a connector housing according to claim 4, wherein said vibration absorbing member is made of a soft resin material and said housing flange is made of a hard resin material.

6. The fitting structure for a connector housing according to claim 1 wherein said vibration absorbing member surrounds each of said bores with a resilient sleeve having a resilient flange which is between said housing flange and said bolt.

7. A fitting structure for a connector housing according to claim 6, wherein said vibration absorbing member is formed together with said housing flange.

8. A fitting structure for a connector housing according to claim 7, wherein said vibration absorbing member is made of a soft resin material and said housing flange is made of a hard resin material.

9. The fitting structure of claim 6 wherein said housing sleeve is a bush and, on an end remote from said mating element, has a bush flange, said resilient flange being between said bush flange and said retaining wall of said housing flange, said retaining wall being on at least one of said housing flange and said bush flange.

10. A fitting structure for a connector housing according to claim 9, wherein said vibration absorbing member is formed together with said housing flange.

11. A fitting structure for a connector housing according to claim 10, wherein said vibration absorbing member is made of a soft resin material and said housing flange is made of a hard resin material.

12. The fitting structure for a connector housing according to claim 9 wherein a sealing member is disposed between said mating element and said connector housing, wherein said bush flange faces said housing flange with a gap therebetween, and wherein said bush is brought into contact with said housing flange when said connector housing is displaced, thereby defining a stop for limiting displacement of said connector housing.

13. A fitting structure for a connector housing according to claim 12, wherein said vibration absorbing member is formed together with said housing flange.

14. A fitting structure for a connector housing according to claim 13, wherein said vibration absorbing member is made of a soft resin material and said housing flange is made of a hard resin material.

* * * * *